United States Patent [19]

Thomsen

[11] 4,113,620

[45] Sep. 12, 1978

[54] PULP PRESS HAVING A PLANAR DEWATERING DISC BELOW AN ANNULAR PRESS CHAMBER

[76] Inventor: Eigild S. Thomsen, 1110 SW. Hallinan Cir., Portland, Oreg. 97034

[21] Appl. No.: 735,906

[22] Filed: Oct. 26, 1976

[51] Int. Cl.[2] ..... B30B 9/20

[52] U.S. Cl. ..... 210/152; 100/116; 162/358; 210/386

[58] Field of Search ..... 210/152, 251, 356, 386; 100/158 C, 116, 177, 110, 121, 155; 162/358, 415

[56] References Cited

U.S. PATENT DOCUMENTS

| | | | |
|---|---|---|---|
| 947,013 | 1/1910 | Dowd | 100/177 X |
| 2,121,932 | 6/1938 | Slocum | 100/177 |
| 2,793,583 | 5/1957 | Messing | 100/158 C X |
| 3,818,824 | 6/1974 | Kloda et al. | 100/116 |

*Primary Examiner*—Frank A. Spear, Jr.
*Attorney, Agent, or Firm*—Chernoff & Vilhauer

[57] ABSTRACT

A press for removing liquid continuously from aqueous pulp comprises a cylindrical housing divided into an upper annular press chamber and a lower working chamber which are separated by a perforated de-watering disk. The press chamber is enclosed on its upper end by a varying height squeeze plate for varying the cross sectional area of the press chamber. The de-watering disk is carried on a rotatably driven shaft which is mounted centrally in the housing. The de-watering disk is configured for passing extensible blades, having a width equal to the width of the press chamber and slidably carried in holders which are joined to the de-watering disk and shaft. A cam which engages the blades is configured for varying the amount of extension of the blades continuously in a manner such that they extend into the press chamber into adjacency with the squeeze plate, substantially filling the press chamber at all times. As the shaft is rotated the pulp, which is supplied to the press chamber at its point of maximum cross sectional area, is moved by the blades in the direction of decreasing press chamber cross sectional area squeezing the liquid out of the pulp through the de-watering disk. The liquid passes into the working chamber where it is removed from the press. As the pulp is moved through the minimum cross sectional area of the press chamber it is pushed out of the press through an exit opening in the housing.

16 Claims, 9 Drawing Figures

PULP PRESS HAVING A PLANAR DEWATERING DISC BELOW AN ANNULAR PRESS CHAMBER

BACKGROUND OF THE INVENTION

This invention relates to a press for removing liquid from aqueous pulp. In particular it relates to such a press which operates continuously with high efficiency removal of liquid at low or high pulp flow rates and at low or high levels of pulp consistency.

The need for removing liquid from aqueous pulp solution occurs often in the paper making, food processing and other similar industries. To facilitate this process mechanical presses have been devised which remove liquid by reducing the volume of the pulp. While a simple squeeze type press is efficient in removing liquid, many processes require a continuously operating press which will receive an uninterrupted supply of pulp from other machinery. Heretofore, the most successful continuously operating presses have utilized rollers or cones operating against a perforated plate for squeezing the pulp.

When these prior art presses are operated at low pulp flow rates or with pulp having a low solid consistency they are inefficient. Further, when they are operated at high pulp flow rates or with pulp having a high solid consistency, overloading often occurs stopping the pressing operation and possibly damaging the press. Overloading particularly occurs when a nonhomogeneous pulp containing varying particle size and solid consistency is processed. As a result, the prior art presses must be operated within a narrow range of pulp flow rates and consistencies unless they are shut down upon each change in pulp conditions for readjustment of their rollers. This presents a severe handicap when the presses are used in conjunction with other continuously operating equipment which discharge pulp at varying flow rates and consistencies.

An additional disadvantage of the cone or roller type presses is that they are difficult to seal. Thus a portion of the removed liquid passes back into the squeezed pulp, rewetting it.

While prior attempts have been made to improve the cone or roller presses, they have increased the complexity and cost of the presses without overcoming the basic problems.

SUMMARY OF THE INVENTION

In its basic concept the press of the present invention comprises a plurality of blades configured for moving pulp about a decreasing volume chamber bounded on one side by a perforated de-watering disk, and which are positioned slidably within the chamber by a cam an amount co-extensive with the height of the chamber.

It is by virtue of the foregoing basic concept that the principal objective of this invention is achieved; namely, to overcome the aforementioned disadvantages and limitations of pulp presses of the prior art.

Another object of the present invention is to provide such a pulp press wherein the blades are carried in housings located outside of the chamber.

Another object of the present invention is to provide such a pulp press which is of simplified construction for economical manufacture and is of rugged, unitary design permitting severe treatment in use.

The aforegoing and other objects and advantages of this invention will be apparent from the following detailed description taken in connection with the accompanying drawings of a preferred embodiment.

DETAILED DESCRIPTION OF A PREFERRED EMBODIMENT

Figure 2:
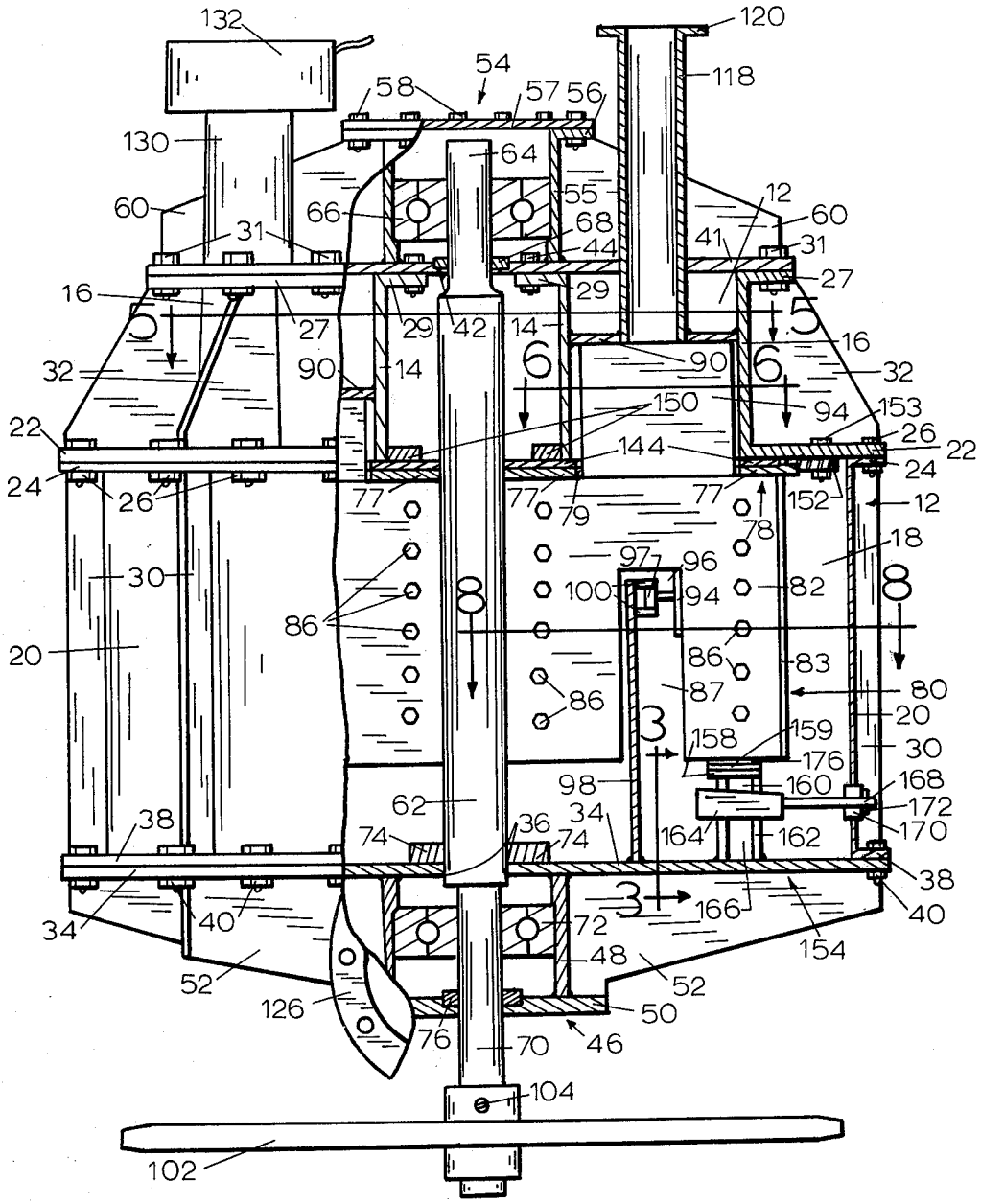
FIG. 2 is a view in side elevation showing a portion of the press of FIG. 1 at an enlarged scale, partially broken away to show details of construction.

Referring to FIG. 2 of the drawings, the press of the present invention includes a housing into which the operative elements are mounted. The housing includes an annular press chamber 12 defined by an inner cylindrical wall 14 and an outer cylindrical wall 16. A working chamber 18 defined by a cylindrical shell 20, having a diameter which is larger than that of wall 16, is located in the housing below the press chamber. An outwardly extending annular lower flange 22, integrally attached to wall 16, is joined to an outwardly extending annular flange 24, integrally attached to shell 20, by means of bolts 26 fixing the two portions of the housing together. An upper flange 27 is attached integrally to the upper end of wall 16, and an upper flange 29 is attached to the upper end of wall 14.

Figure 1:
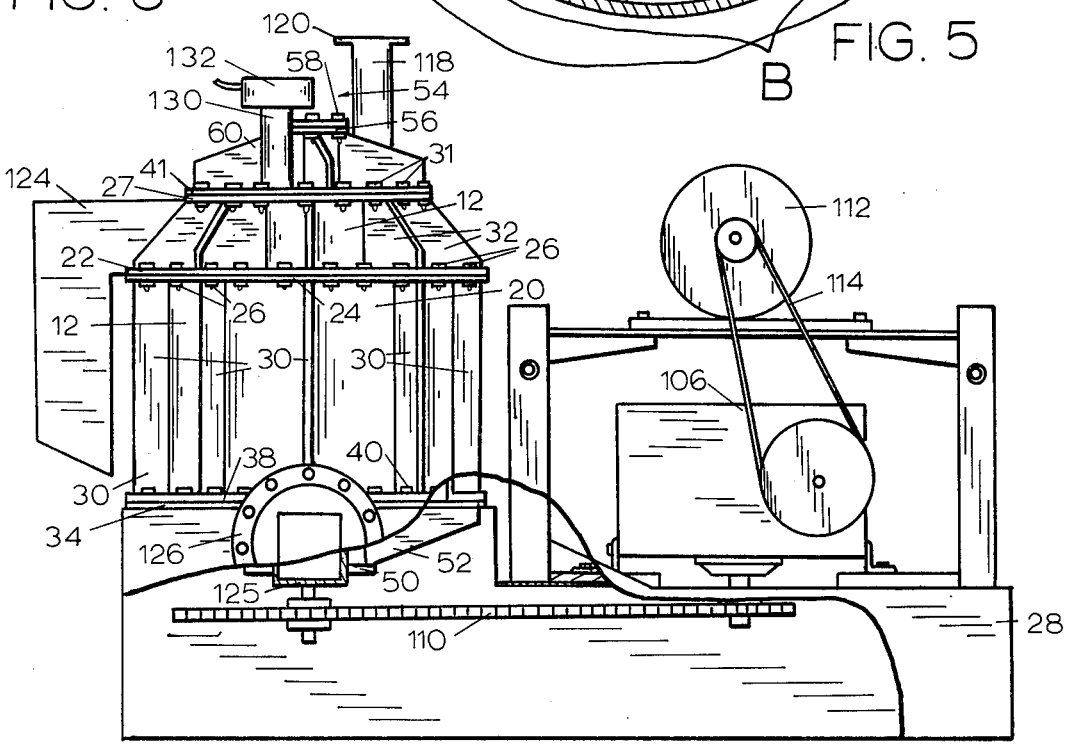
FIG. 1 is a view in side elevation showing the press of the present invention, partially broken away to show details of construction.

In the embodiment illustrated the housing is mounted vertically on a frame 28, FIG. 1, with the first cavity located above the second cavity. The shell 20 is stiffened by rectangular stiffeners 30 attached to the shell at spaced intervals, such as by welding. The outer wall 16 is stiffened by generally triangular shaped stiffeners 32 which extend between flanges 22 and 27 at spaced intervals.

A cylindrical bottom plate 34, defining a medial opening 36, is attached to the lower extremity of shell 20 enclosing the lower end of the working chamber. The plate is attached to an annular flange 38, which extends radially outwardly from integral joinder with the shell, by means of bolts 40. A cylindrical top plate 41 defining a medial opening 42 is attached to flanges 27 and 29, by means of bolts 31 and 44 respectively, enclosing the upper end of press chamber.

A lower bearing holder 46 comprising a vertical cylindrical portion 48 and a horizontal flat annular plate 50 is integrally joined to bottom plate 34 such as by welding. Gussets 52 interconnect the bottom plate and the lower bearing holder at spaced intervals adding stiffness to the lower portion of the housing. An upper bearing holder 54 having a cylindrical portion 55 joined to an annular flange 56 is integrally attached to the top plate 41. A circular top 57 is attached releasably to flange 56 by bolts 58. Gussets 60 interconnect the top plate and the upper bearing holder at spaced intervals adding stiffness to the upper portion of the housing.

Figure 5:
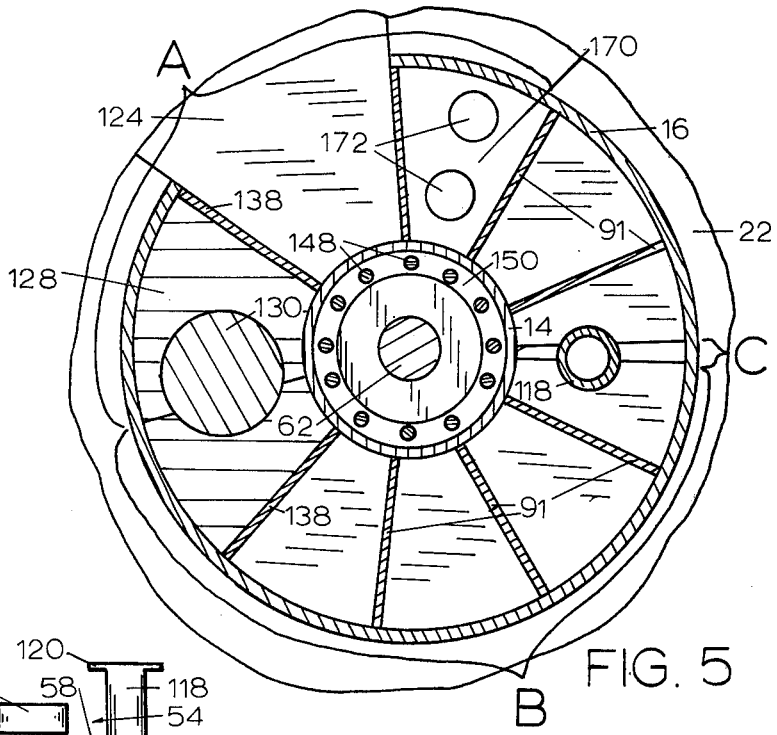
FIG. 5 is a fragmentary sectional view taken on the line 5—5 of FIG. 2.

An annular squeeze plate 90 is located in the upper terminal portion of the press chamber forming one end of the chamber. It is mounted to the top plate by spaced webs 91, FIG. 5, having varying heights. Thus the squeeze plate has a height which varies as it extends around the press chamber.

Figure 9:
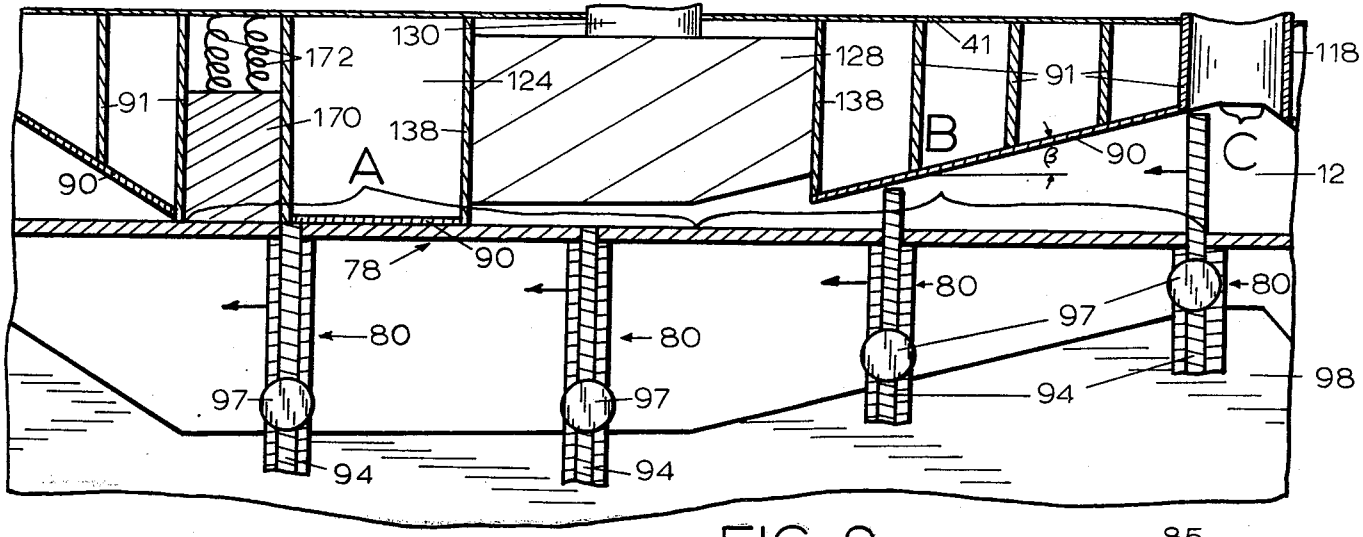
FIG. 9 is a semi-diagrammatic view, in section, showing the layout of the pressing elements of the present invention.

Referring to the layout shown in FIG. 9, when the height of the squeeze plate is at its maximum it provides the minimum cross sectional area "A" in the press chamber. The minimum area "A" extends over a radial angle which preferably is between 90° and 120° and which is shown in the embodiment illustrated as being 110°. Progressing counterclockwise from the minimum area, looking from above, the height of the plate then decreases forming a sloped section "B." At the end of the sloped section the plate reaches its minimum height forming the maximum cross sectional area "C" in the press chamber. Preferably the sloped section "B" has a constant angle $\beta$ between 10° and 20°, and in the embodiment illustrated about 15°. The angular extent covered by the sloped section "B" in the embodiment illustrated is about 200° of arc. The minimum area "A" extends over a short radial segment, preferably between 7° and 15° of arc and illustrated as being 10°. The height of the plate then increases at a constant slope to its maximum height at "C." This slope is much steeper than the prior slope, however its angle is less critical being determined primarily by the overall height variation of the squeeze plate.

The squeeze plate contains an adjustable section 128 which is located over a portion of the minimum area section "A" and a portion of the sloped section "B" adjacent thereto. In the embodiment illustrated the adjustable section covers approximately the downstream one-half of the minimum area section and a like radial amount of the sloped section. The adjustable section is movably mounted on a piston-cylinder 130, which is attached to the top plate 41. The piston cylinder is interconnected to an accumulator 132 and a hand operated pump (not shown). Thus the adjustable section is movable upwardly and downwardly altering the cross sectional area of the press chamber over its extent. Vertical seals 138 are mounted on the squeeze plate adjacent to each side of the adjustable section.

A seal 170 is located in the squeeze plate at the downstream end of the minimum area section "A" of the press chamber. The seal comprises a movable segment fabricated from an anti-friction material. It is mounted for vertical movement on springs 172 which urge it downwardly.

Rotatably mounted in the center of the housing is an elongated shaft 62. The shaft has a reduced diameter upper terminal portion 64 which is journaled in an upper bearing 66. The upper bearing is fixedly joined to the upper bearing holder 54, such as by pressing. A seal 68, located in the opening 42 of the top plate 41, seals the shaft at the lower end of the upper bearing holder.

The shaft has a reduced diameter lower terminal portion 70 which is journaled in a lower bearing 72. The lower bearing is press fit into the lower bearing holder 46. A seal 74, located adjacent to opening 36 in the bottom plate 34, and a seal 76, located in the opening in the plate 50, seal the shaft respectively at the upper and lower end of the lower bearing holder. The lower terminal portion 70 of shaft 62 extends outwardly of the housing a short distance.

Figure 7:
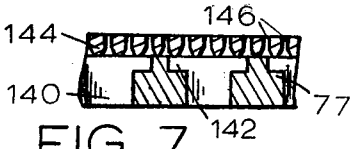
FIG. 7 is a fragmentary sectional view taken on the line 7—7 of FIG. 6.

Attached to the shaft intermediate its ends is a de-watering disk 78. The de-watering disk is located on the shaft in a manner for dividing the press chamber 12 from the working chamber 18. The de-watering disk includes a circular support plate 77, FIG. 7, having a diameter which is slightly smaller than the diameter of shell 20 and which is welded to the shaft. Located in a spaced array in the support plate are a plurality of bores 140 with larger diameter counter bores 142 located at their upper portions. Mounted above the support plate is a screen plate 144 which is thinner than the support plate and has a plurality of smaller bores 146 passing therethrough. Thus each of the counter bores 142 opens to several of the smaller bores 146. Screws 148 pass through countersunk openings in the screen plate into threaded openings in the support plate joining the two elements together.

An annular seal 150 is attached to the upper surface of the screen plate, by means of screws 148, inwardly adjacent to the inner wall 14. An L-shaped annular seal 152 is attached to the lower surface of lower flange 22 outwardly adjacent to the edge of the de-watering disk by means of bolts 153.

Figure 6:
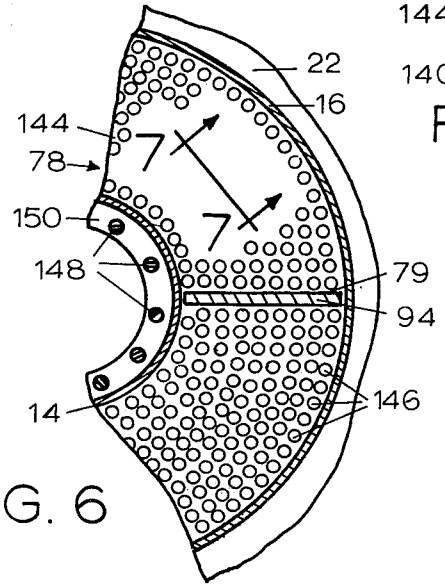
FIG. 6 is a fragmentary sectional view taken on the line 6—6 of FIG. 2.

Four equally spaced radial openings 79, FIG. 6, are located in the de-watering disk between the press chamber and the working chamber.

Figure 8:
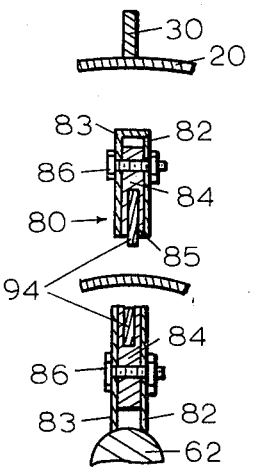
FIG. 8 is a fragmentary sectional view taken on the line 8—8 in FIG. 2.

Located immediately below the de-watering disk and extending into the working chamber 18 are holders 80. In the embodiment illustrated four such holders are attached to the de-watering disk at equally spaced locations, one below each slot 79. The holders each comprise a flat plate 82 and L-shaped plate 83 which are spaced apart for mounting on each side of paired tracks 84, FIG. 8, formed from an anti-friction material. One track extends along each vertical edge of the holders and defines an inwardly facing groove 85. The plates and tracks are joined together by bolts 86 into integral units.

In the embodiment illustrated the holders generally are rectangular. Their top edge is joined to the de-watering disk 78, their bottom edge extends to within a short distance of bottom plate 34, their inner edge is integrally joined to shaft 62, and their outer edge extends to within a short distance of shell 20. Thus the holders rotate along with shaft 62 and de-watering disk 78 as an integral unit. Slots 87 located medially in the holders between the tracks extend from their lower margins upwardly over approximately two-thirds of the height of the holders.

Figure 3:
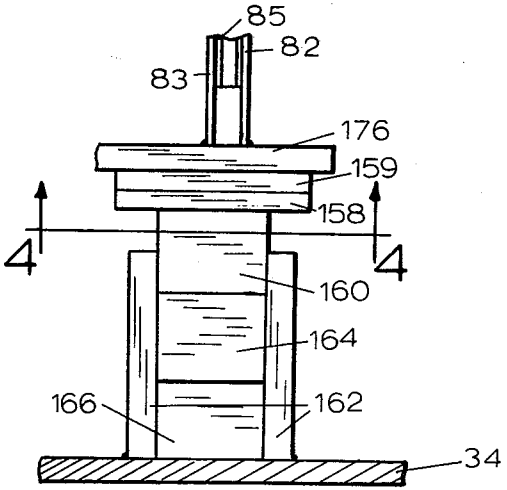
FIG. 3 is a fragmentary sectional view taken on the line 3—3 of FIG. 2.
Figure 4:
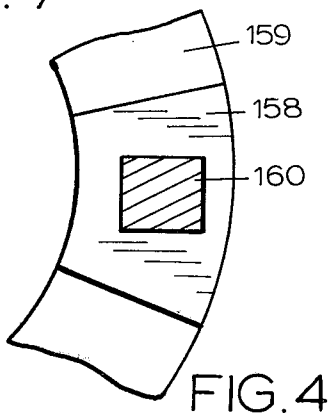
FIG. 4 is a fragmentary sectional view taken on the line 4—4 of FIG. 3.

Thrust bearings 154, FIGS. 3 and 4, are located below the holders 80 transmitting downward loads from the holders to the housing. To this end a ring 176 is welded to the bottom of the holders. In the embodiment illustrated each thrust bearing includes a lower anti-friction pad 158, integrally joined to a shoe 160, and an upper anti-friction pad 159 joined to ring 176. Each shoe slidably fits within a bifurcated bracket 162 attached to the bottom plate 34 of the housing. A trapezoidal wedge 164 slidably fits within each bracket 162 above a lower support block 166 and below shoe 160. The wedge is joined to a threaded rod 168 which extends through a threaded bore in a bushing 170 which is mounted in shell 20. A nut 172 which fits on rod 168 outside the bushing allows inward and outward adjustment of the wedge for adjusting the force on the thrust bearing.

Located slidably within the tracks 84 of holders 80 are extensible blades 94. The blades have a width for fitting into the press chamber and a length slightly shorter than the length of the holders. Thus the blades may be moved between retracted positions entirely enclosed within the holders and extended positions. When in their extended positions the blades pass through openings 79 in the de-watering disk into the press chamber. As a result they may be positioned to completely block the press chamber at any radial position or squeeze plate height.

The blades contain medial slots 96 in their lower portions, which are arranged to be co-extensive with the slots 87 in the holders when the blades are in their extended positions. Mounted to the blades in the lower portion of their slots 96 are roller followers 97. The roller followers are engaged by a thin walled cylindrical cam plate 98 which is fixed to the bottom plate 34 of the housing. The cam plate has a diameter to fit medially within the slots 87 and 96 of the holders and blades respectively.

The cam plate has a varying height about its diameter which creates a mirror image of the height of the squeeze plate. Thus its point of maximum height is arranged to be in alignment with the point of minimum height of the squeeze plate. Located at the upper edge of the cam plate is a track 100 into which the roller followers fit, causing the blades to follow the contour of the cam plate positioning them in a manner to fill the press chamber as they are rotated.

In the embodiment illustrated actuation means for operating the press includes a sprocket 102 mounted on the lower portion of the central shaft 62 which extends outwardly of the housing. The sprocket is attached to the shaft by conventional means such as a set screw 104 and is fixed thereto by a key (not shown).

Mounted in the frame beside the housing is a gear reduction unit 106 having a drive sprocket which is mounted on its output shaft and aligned with sprocket 102. A chain 110 operably interconnects the two sprockets. Power means, such as motor 112, is operably interconnected to the gear reduction unit by chain 114. Preferably the motor, gear reduction unit and sprockets are arranged to cause the central shaft to rotate between 5 and 30 RPM.

An inlet is located in the housing in a manner for introducing aqueous pulp into the press chamber. Preferably the inlet should be located for entering the press chamber at its point of maximum area "C." In the embodiment illustrated the inlet enters the press chamber through an opening in the squeeze plate 90 and comprises a pipe 118 having a terminal flange 120. Thus a mating flange from pulp handling equipment can easily be attached to the press.

An outlet is located in the housing in a manner for removal of the dehydrated pulp from the first cavity after the water has been squeezed from it. Preferably the outlet enters the press chamber downstream of the adjustable section 128 of the squeeze plate in the minimum cross sectional area section "A." In the embodiment illustrated the outlet comprises a rectangular duct 124 which enters the cavity through the outer wall 16 of the housing. The duct is fabricated to discharge the pulp downwardly from the press into a suitable transportation mechanism.

A drain, such as rectangular duct 125, is located in the housing for removal of the water pressed from the pulp into the working chamber. The duct 124 enters the working chamber through bottom plate 34. A flange 126 is located on the end of the duct for joinder with a plumbing system for passage of the water to a suitable treatment system prior to discharge.

OPERATION

In the operation of the present invention aqueous pulp is fed into the inlet through pipe 118 which is connected to the outlet of another piece of pulp processing equipment. It will be noted from FIG. 9 that the pulp enters the press chamber at its point of maximum cross sectional area "C."

The motor 112 operates the press through gear reduction unit 106 rotating shaft 62 along with the holders 80 and blades 94 at approximately 5 to 30 RPM. As they rotate the blades are moved to their extended positions continuously by the action of followers 97 on cams 98. Therefore, the blades always fill the press chamber except at the adjustable section 128 of the squeeze plate.

As the blades are rotated about the press chamber the pulp is moved with them and is squeezed into a progressively smaller cross sectional area forcing the water out through the openings in the de-watering disk. The smaller bores 146 in the screen plate prevent passage of the pulp therethrough. It will be noted that each of the counter bores 142 aligns with many smaller bores 146 in the screen plate permitting maximum passage of water without unduly sacrificing the strength of the support plate. Thus the water which is squeezed out of the pulp passes into the working cavity 18 and thence out of the press through duct 125 to be either disposed of or recycled. The de-watered pulp then is forced out of the exit duct 124 for further processing.

In order to accommodate the pulp through the minimum cross sectional area of the first chamber the adjustable section 128 is allowed to be displaced slightly as shown in FIG. 9. The amount of displacement depends on the pressure initially set in accumulator 132 by the pump. As the amount of pulp passing through the press increases the force it exerts against the adjustable section also increases, causing the piston-cylinder to be retracted against the fixed hydraulic pressure. Thus the adjustable section automatically adjusts providing a constant squeezing pressure in the press regardless of the consistency or water content of the pulp being supplied.

Seal 170 located in the downstream portion of the minimum area section "A" wipes the screen plate and prevents flow of water between the inlet and exit.

Having thus described by invention in a specific embodiment, I claim:

1. A press for removing liquid continuously from aqueous pulp comprising:
   (a) a cylindrical housing;
   (b) a planer de-watering disk located intermediate the ends of the housing dividing the housing into a press chamber and a working chamber, said de-watering disk defining a plurality of openings therethrough arranged for preventing passage of the pulp while permitting passage of the liquid;
   (c) a cylindrical sleeve located centrally in the press chamber so as to form an annular chamber therefrom;
   (d) an annular squeeze plate located in the press chamber forming the end thereof opposite the de-watering disk, said squeeze plate being arranged in a manner for causing the cross-sectional area of the press chamber to range from a maximum area to a minimum area progressing angularly around the press chamber;

(e) at least two blades located at spaced angular positions in the working chamber and arranged for being extensible into the press chamber, each blade having a width substantially equal to the width of the press chamber, and actuation means operably engaging the blades in a manner for movement of the blades around the press chamber;

(f) means located exteriorily of the press chamber for continuously varying the extension of said blades into the press chamber, said means configured for positioning the blades in a manner such that the blades substantially fill the press chamber between the de-watering disk and the squeeze plate at all times;

(g) inlet means located in the housing in a manner for introducing aqueous pulp into the press chamber substantially at its point of maximum area;

(h) outlet means located in the housing in a manner for removal of dehydrated pulp from the press chamber substantially at its point of minimum area; and (i) drain means located in the housing in a manner for removal of liquid from the working chamber.

2. The press of claim 1 wherein the de-watering disk comprises:

(a) a support plate having a plurality of bores passing therethrough and having larger diameter counter bores located in that portion of the cylindrical openings facing the press chamber; and (b) a screen plate attached to the surface of the support plate facing the press chamber and having a plurality of relatively smaller bores passing therethrough arranged in a manner such that several of said smaller bores align with each counter bore in the support plate.

3. The press of claim 1 further including:

(a) a central shaft rotatably mounted in the housing;

(b) the de-watering disk being fixed to the shaft for rotating therewith, and defining radial openings dimensioned for passing the blades;

(c) holders, configured for receiving the blades slidably therein, located in the working cavity, and joined to the shaft and to the de-watering disk for rotation therewith; and (d) said holders being located adjacent to the radial openings in the de-watering disk permitting translation of the blades therethrough between retracted positions completely within the working chamber and extended positions at least partially within the press chamber.

4. The press of claim 3 wherein the holders comprise spaced apart paired plates, and tracks sandwiched between said pairs of plates, said tracks defining grooves for receiving the blades.

5. The press of claim 3 wherein the holders define medial slots exposing the blades, and the blades define medial slots arranged to be at least partially co-extensive with the slots in the holders when the blades are in their retracted positions, and the means for continuously varying the height of the blades comprises:

(a) a thin walled cylindrical cam plate fixed to the housing in a position extending between the slots in the blades and the holders;

(b) said cam having a varying height about its diameter arranged to follow the contour of the squeeze plate, with its point of maximum height arranged to be aligned with the point of maximum area of the press chamber and its point of minimum height arranged to be aligned with the point of minimum area of the press chamber; and (c) roller followers mounted on the blades for engaging the cam, said cam and roller followers arranged so that the blades continuously fill the press chamber between the squeeze plate and the de-watering disk as the central shaft is rotated.

6. The press of claim 3 wherein the central shaft extends outwardly of the housing, and the actuation means comprises a sprocket mounted on the shaft, power means mounted externally of the housing, a drive sprocket mounted on the power means and a chain interconnecting said sprockets.

7. The press of claim 6 including gear reduction means interconnecting the power means and the shaft arranged for operating the shaft between 5 and 10 RPM.

8. The press of claim 1 wherein the squeeze plate comprises an adjustable section located adjacently upstream of and at the point of minimum area of the first cavity, said adjustable section being movably mounted in the squeeze plate for increasing the cross-sectional area of the press chamber selectively over the extent of the adjustable section.

9. The press of claim 1 wherein the inlet means enters the press chamber through the squeeze plate.

10. The press of claim 1 wherein the outlet means enters the press chamber through the housing side wall.

11. The press of claim 1 wherein the minimum area of the press chamber extends over a radial section having a large angle.

12. The press of claim 11 wherein said angle is between 90° and 120°.

13. The press of claim 11 wherein the maximum area of the press chamber extends over a radial section having a finite angle.

14. The press of claim 13 wherein said angle is between 7° and 15°.

15. The press of claim 13 wherein the slope defined by the squeeze plate between the minimum area section and the maximum area section of the press chamber is constant.

16. The press of claim 15 wherein the included angle of said slope is between 10° and 20°.

* * * * *